US006094633A

United States Patent [19]

Gaved et al.

[11] Patent Number: 6,094,633

[45] **Date of Patent: *Jul. 25, 2000**

[54] GRAPHEME TO PHONEME MODULE FOR SYNTHESIZING SPEECH ALTERNATELY USING PAIRS OF FOUR RELATED DATA BASES

[75] Inventors: Margaret Gaved, Ipswich; James Hawkey, Heslington, both of United Kingdom

[73] Assignee: British Telecommunications public limited company, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/525,729

[22] PCT Filed: Mar. 7, 1994

[86] PCT No.: PCT/GB94/00430

§ 371 Date: Dec. 2, 1996

§ 102(e) Date: Dec. 2, 1996

[87] PCT Pub. No.: WO94/23423

PCT Pub. Date: Oct. 13, 1994

(Under 37 CFR 1.47)

[30] Foreign Application Priority Data

Mar. 26, 1993 [EP] European Pat. Off. ..... 93302383

[51] Int. Cl.[7] ..... G10L 13/08

[52] U.S. Cl. ..... 704/260; 704/266

[58] Field of Search ..... 704/260, 235, 704/266, 257

[56] References Cited

PUBLICATIONS

Jonathan Allen, "Machine–to–Man Communication by Speech Part II: Synthesis of Prosodic Features of Speech by Rule", Proc. of the Spring Joint Computer Conference, Apr. 30–May 2, 1968, pp. 339–344.

Francis Lee, "Machine–to–Man Communication by Speech Part I: Generation of Segmental Phonemes from Text" Proc. of the Spring Joint Computer Conference, Apr. 30–May 2, 1968.

Klatt, "Review of Text–to–Speech Conversion for English", J. Acoust. Soc. Am., vol. 82, No. 3, Sep. 1987, pp. 737–793.

Furni, Digital Speech Processing, Synthesis and Recognition, 1989, Marcel Dekker, Inc., pp. 220–224.

Rowden, Speech Processing, 1992, McGraw–Hill Book Company, pp. 184–221 (Chapter 6).

*Primary Examiner*—David D. Knepper
*Attorney, Agent, or Firm*—Nixon & Vanderhye P.C.

[57] ABSTRACT

Synthetic speech is generated from conventional texts and in particular by converting text in graphemes into a text in phonemes. The grapheme text is analyzed into rimes and onsets, and each word is analyzed from the end so that earlier-occurring segments are at least partially defined by the identification of later-occurring segments. It is a particular feature that an internal string of consonants, i.e., a string of consonants preceded and followed by a vowel, is split into two portions, namely, a second portion which is contained in a database of onsets, and an earlier portion which, together with the preceding vowel or vowels, is contained in a database of rimes.

13 Claims, 1 Drawing Sheet

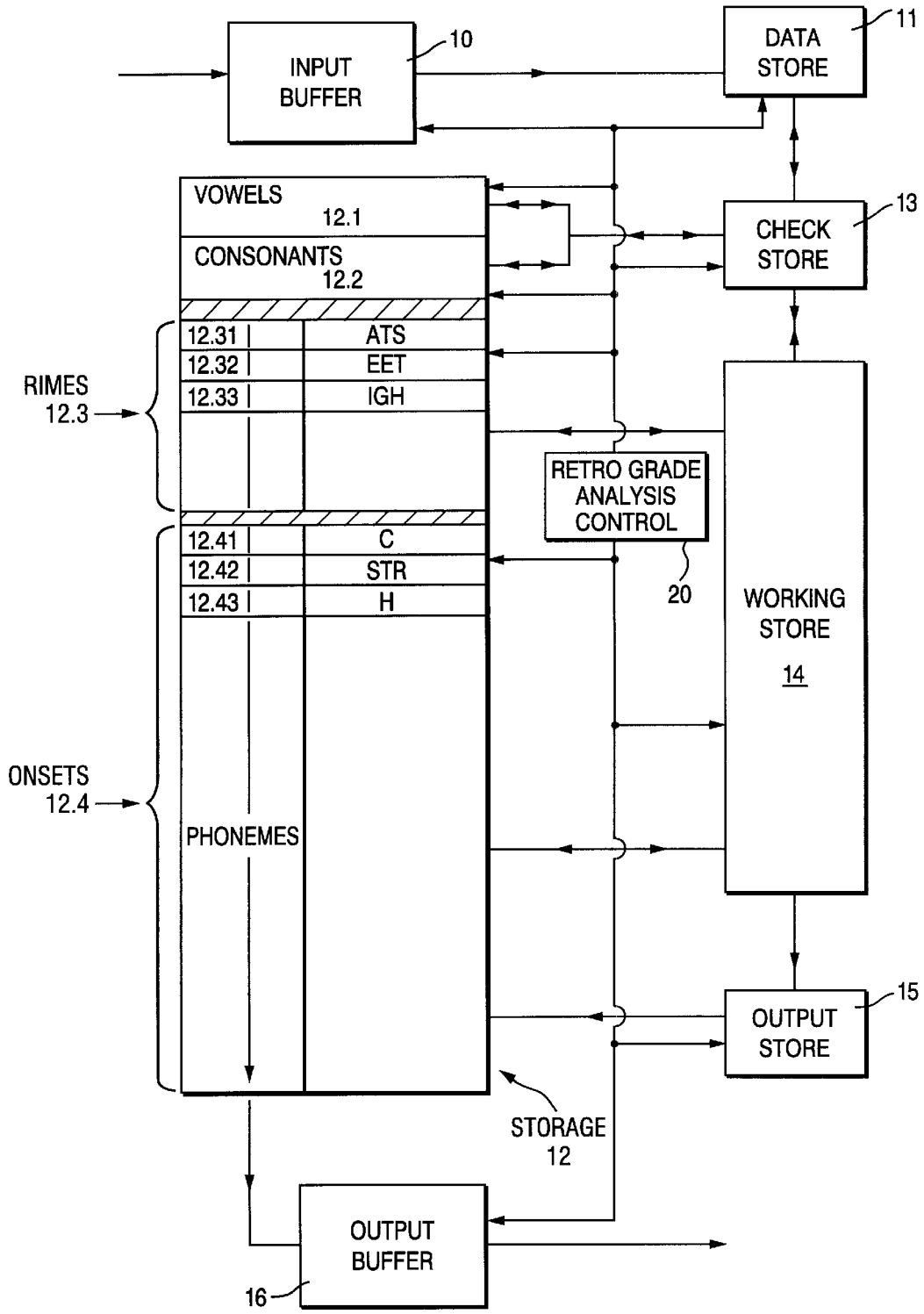
INPUT BUFFER
10
DATA STORE
11
VOWELS
12.1
CONSONANTS
12.2
CHECK STORE
13
12.31
ATS
12.32
EET
12.33
IGH
RIMES
12.3
RETRO GRADE ANALYSIS CONTROL
20
12.41
C
12.42
STR
12.43
H
WORKING STORE
14
ONSETS
12.4
PHONEMES
OUTPUT STORE
15
STORAGE
12
OUTPUT BUFFER
16

GRAPHEME TO PHONEME MODULE FOR SYNTHESIZING SPEECH ALTERNATELY USING PAIRS OF FOUR RELATED DATA BASES

This application is a 371 of PCT/GB94/00430, filed Mar. 7, 1994.

BACKGROUND OF THE INVENTION

1. Field of the Invention

This invention relates to a method and apparatus for converting text to a waveform. More specifically, it relates to the production of an output in form of an acoustic wave, namely synthetic speech, from an input in the form of signals representing a conventional text.

2. Related Art

This overall conversion is very complicated and it is sometimes carried out in several modules wherein the output of one module constitutes the input for the next. The first module receives signals representing a conventional text and the final module produces synthetic speech as its output. This synthetic speech may be a digital representation of the waveform followed by conventional digital-to-analogue conversion in order to produce the audible output. In many cases it is desired to provide the audible output over a telephone system. In this case it may be convenient to carry out the digital-to-analogue conversion after transmission so that transmission takes place in digital form.

There are advantages in the modular structure, e.g. each module is separately designed and any one of the modules can be replaced or altered in order to provide flexibility, improvements or to cope with changing circumstances.

Some procedures utilise a sequence of three modules, namely (A) pre-editing, (B) conversion of graphemes to phonemes, and (C) conversion of phonemes to (digital) waveform.

A brief description of these modules will now be given.

Module (A) receives signals representing a conventional text, e.g. the text of this specification, and it modifies selected features. Thus module (A) may specify how numbers are processed. For example, it will decide if

"1345"

becomes

One three four five

Thirteen forty-five or

One thousand three hundred and forty-five.

It will be apparent that it is relatively easy to provide different forms of module (A), each of which is compatible with the subsequent modules so that different forms of output result.

Module (B) converts graphemes to phonemes. "Grapheme" denotes data representations corresponding to the symbols of the conventional alaphbet used in the conventional manner. The text of this specification is a good example of "graphemes". It is a problem of synthetic speech that the graphemes may have little relationship to the way in which the words are pronounced, especially in languages such as English. Therefore, in order to produce waveforms, it is appropriate to convert the graphemes into a different alphabet, called "phonemes" in this specification, which has a very close correlation with the sound of the words. In other words it is the purpose of module (B) to deal with the problem that the conventional alphabet is not phonetic.

Module (C) converts the phonemes into a digital waveform which, as mentioned above, can be converted into an analogue format and thence into audible waveform.

This invention relates to a method and apparatus for use in module (B) and this module will now be described in more detail.

Module (B) utilises linked databases which are formed of a large number of independent entries. Each entry includes access data which is in the form of representations, eg bytes, of a sequence of graphemes and an output string which contains representations, eg bytes of the phoneme equivalent to the graphemes contained in the access section. A major problem of grapheme/phoneme conversion resides in the size of database necessary to cope with a language. One simple, and theoretically ideal, solution would be to provide a database so large that it has an individual entry for every possible word in the language, including all possible inflections of every possible word in the language. Clearly, given a complete database, every word in the input text would be individually recognised and an excellent phoneme equivalent would be output. It should be apparent that it is not possible to provide such a complete database. In the first place, it is not possible to list every word in a language and even if such a list were available it would be too large for computational purposes.

Although the complete database is not possible, it is possible to provide a database of useable dimension which contains, for example, common words and words whose pronunciation is not simply related to the spelling. Such a database will give excellent grapheme/phoneme conversion for the words included therein but it will fail, i.e. give no output at all, for the missing words. In any practical implementation this would mean an unacceptably high proportion of failure.

Another possibility uses a database in which the access data corresponds to short strings of graphemes each of which is linked to its equivalent string of phonemes. This alternative utilises a manageable size of database but it depends upon analysis of the input text to match strings contained therein with the access data in the database. Systems of this nature can provide a high proportion of excellent pronunciations with occurrences of slight and severe mispronunciation. There will also be a proportion of failures wherein no output at all is produced either because the analysis fails or a needed string of graphemes is missing from the access section of the database.

A final possibility is conveniently known as a "default" procedure because it is only used when preferred techniques fail. A "default" procedure conveniently takes the form of "pronouncing" the symbols of the input text. Since the range of input symbols is not only known but limited (usually less than 100 and in many cases less than 50) it is not only possible to produce the database but its size is very small in relation to the capacity of modern data storage systems. This default procedure therefore guarantees an output even though that output may not be the most appropriate solution. Examples of this include names in which initials are used, degrees and honours, and some abbreviations for units. It will be appreciated that, in these circumstances, it is usual to "pronounce" out the letters and on these occasions the default procedures provides the best results.

Three different strategies for converting graphemes to phonemes have just been identified and it is important to realise that these alternatives are not mutually exclusive. In fact it is desirable to use all three alternatives according to a strict order of precedence. Thus the "whole word" database is used first and, if it gives an output, that output will be excellent. When it fails "the analysis" technique is used which may involve a small but acceptable number of mispronunciations. Finally if the "analysis" fails the default option of pronouncing the "letters" is utilized and this can be guaranteed to give an output. Although this may not be completely satisfactory, it will, in a proportion of cases as explained above, give the most appropriate result.

SUMMARY OF THE INVENTION

This invention relates to the middle option in the sequence outlined above. That is to say this invention is concerned with the analysis of the data representations corresponding to input text graphemes in order to produce an output set of data representations being the phonemes corresponding to the input text. It is emphasised that the working environment of this invention is the complete text-to-waveform conversion as described in greater detail above. That is to say this invention relates to a particular component of the whole system.

According to an aspect of this invention, an input sequence of bytes, e.g., data representations representing a string of characters selected from a first character set such as graphemes, is dissected into sub-strings for conversion into an output sequence of bytes, e.g., data representations representing a string of characters selected from a second character set such as phonemes. The method includes retrograde analysis performed in conjunction with signal storage means which includes first, second, third and fourth storage areas. The first storage area contains a plurality of bytes each of which represents a character selected from the first character set. The second storage area contains a plurality of bytes each of which represents a character selected from the first character set, the total content of the second storage area being different from the total content of the first storage area. The third storage area contains strings consisting of one or more bytes representing characters of the first character set, wherein the one byte of each string (or the first byte of each string of more than one byte) is a byte contained in the first storage area. The fourth storage area contains strings of one or more bytes each of which is a byte contained in the second storage area.

The bytes stored in the first area preferably represent vowels whereas those of the second area preferably represent consonants. Overlaps, e.g. the letter "y", are possible. The strings in the third storage area preferably represent rimes and those of the fourth area preferably represent onsets. The concepts of vowels, consonants, rimes and onsets will be explained in greater detail below:

The division involves matching sub-strings of the input signal with strings contained in the third and fourth storage areas. The sub-strings for comparison are formed using the first and second storage areas.

The retrograde analysis requires that later occurring sub-strings are selected before earlier occurring sub-strings. Once a sub-string has been selected, the bytes contained therein are no longer available for selection or re-selection so as to form an earlier occurring sub-string. This non-availability limits the choice for forming the earlier sub-string and, therefore, the prior selection at least partially defines the latter selection of the earlier sub-string.

The method of the invention is particularly suitable for the processing of an input string divided into blocks, e.g. blocks corresponding to words, wherein a block is analyzed into segments beginning from the end and working to the beginning wherein the choice of segment is taken from the end of the remaining unprocessed string.

The invention, which is defined in the claims, includes the methods and apparatus for carrying out the methods.

The data representations, eg bytes, utilised in the method according to this invention take any signal form which is suitable for use in computing circuitry. be stored, including transient storage as part of processing, in a suitable storage medium, e.g. as the degree of and/or the orientation of magnetisation in a magnetic medium.

the theoretical basis and some preferred embodiments of the invention will now be described. In the preferred embodiments the input signals are divided into blocks which correspond to the individual words of the text and the invention works on each block separately; thus the process can be considered as "word-by-word" processing.

It is now convenient to restate the requirement that it is not necessary to produce an output for every one of the blocks because, as described above, the whole system includes further modules to deal with such failures.

As a preliminary, it is convenient to illustrate the theoretical basis of the invention by considering the structure of words in the English language and by commenting on the structures of a few specific words. This analysis uses the distinction usually identified as "vowels" and "consonants". For mechanical processing it is necessary to store two lists of characters. One of these lists contains the characters specified as "vowels" and the other lists contains those characters designated as "consonants". All characters are, preferably, included in one or other of the lists but, in the preferred embodiment, the data representations corresponding to "Y" are included in both lists. This is because conventional English spelling sometimes utilises the letter "Y" as a vowel and sometimes as a consonant. Thus the first list (of vowels) contains a, e, i, o, u and y, whereas the second list of consonants contains b, c, d, f, g, h, j, k, l, m, n, p, q, r, s, t, v, w, x, y, z. The fact that "Y" appears in both lists means that the condition "not vowel" is different from the condition "consonant".

The primary purpose of the analysis is to split a block of data representations, ie. a word, into "rimes" and "onsets". It is important to realise that the analysis uses linked databases which contain the grapheme equivalents of rimes and onsets linked to their phoneme equivalents. The purpose of the analysis is not merely to split the data into arbitrary sequences representing rimes and onsets but into sequences which are contained in the database.

A rime denotes a string of one or more characters each of which is contained in the list of vowels or such a string followed by a second string of characters not contained in the list of vowels. An alternative statement of this requirement is that a rime consists of a first string followed by a second string wherein all the characters contained in the first string are contained in the list of vowels and the first string must not be empty and the second string consists entirely of characters not found in the list of vowels with the proviso that the second string may be empty.

An onset is a string of characters all of which are contained in the list of consonants.

The analysis requires that the end of a word shall be a rime. It is permitted that the word contains adjacent rimes, but it is not permitted that it contains adjacent onsets. It has been specified that the end of the word must be a rime but it should be noted that the beginning of the word can be either a rime or an on-set; for instance "orange" begins with a rime whereas "pear" begins with an onset.

In order to illustrate the underlying theory of the invention four specimen words, arbitrarily selected from the English language, will be displayed and analysed into their rimes and onsets.

FIRST SPECIMEN

CATS
rime "ats"
onset "c"

It is to be expected that "ats" will be listed as a rime and "c" will be listed as an onset. Therefore replacing each by its phoneme equivalent will convert "cats" into phonemes.

It should be noted that the rime "ats" has a first string consisting of the single vowel "a" and a second string which consists of two non-vowels namely "t" and "s".

SECOND SPECIMEN

STREET
rime "eet"
onset "str".

In this case the first string of the rime contains two letters namely "ee" and the second string is a single non-vowel "t". The onset consists of a string of three consonants.

The onset "str" and the rime "eet" should both be contained in the database so that phoneme equivalents are provided.

THIRD SPECIMEN

HIGH
rime "igh"
onset "h"

In this example the rime "igh" is one of the arbitrary of sounds of the English language but the database can give a correct conversion to phonemes.

FOURTH SPECIMEN

HIGHSTREET
second rime "eet"
second onset "str"
first rime "igh"
first onset "h".

Clearly the word "highstreet" is a compound of the previous two examples and its analysis is very similar to these two examples. However, there is an important extra requirement in that it is necessary to recognise that there is a break between the fourth and fifth letters in order to split the word into "high" and "street". This split is recognised by virtue of the contents of the database. Thus the consonant string "ghstr" is not an onset in the English language and, therefore, it will not be in the database so that it cannot be recognised. Furthermore the string "hstr" will not be in the database. However, "str" is a common onset in English and it should be in the database. Therefore "str" can be recognised as an onset and "str" is the later part of the string "ghstr". Once the end of the string has been recognised as an onset the earlier part is identified as part of the preceding rime and the word "high" can be split as described above. It is the purpose of this example to illustrate that the splitting of an internal string of consonants is sometimes important and that the split is achieved by the use of the database.

BRIEF DESCRIPTION OF THE DRAWING

We have now given a description of the theory which underlies the techniques of the invention and it is not appropriate to indicate how this is carried into effect using automatic computing equipment, which is illustrated in the accompanying diagrammatic drawing.

DETAILED DESCRIPTION OF EXEMPLARY EMBODIMENTS

The computing equipment operates on strings of signals, eg. electrical pulses. The smallest unit of computation is a string of signals corresponding to a single grapheme of the original text. For convenience such a string of signals will be designated as a "byte" no matter how many bits it contains in the "byte". Originally the term "byte" indicated a sequence of 8 bits. Since 8 bits provides count of 255 this is sufficient to accommodate most alphabets. However, the "byte" does not necessarily contain 8 bits.

The processing described below is carried out block-by-block wherein each block is a string of one or more bytes. Each block corresponds to an individual word (or potential word, since it is possible that the data will contain blocks which are not translatable so that the conversion must fail). The purpose of the method is to convert an input block whose bytes represent graphemes into an output block whose bytes represent phonemes. The method words by dividing the input block into sub-strings, converting each sub-string in a look-up table and then concatenating to produce the output block.

The operational mode of the computing equipment has two operation procedures. Thus it has a first procedure which includes two phases and the first procedure is utilised for identifying bytes strings corresponding to rimes. The second procedure has only one phase and it is used for identifying byte strings corresponding to onsets.

As indicated in the drawing, the computing equipment comprises an input buffer 10 which holds blocks from previous processing until they are ready to be processed. The input buffer 10 is connected to a data store 11 and it provides individual blocks to the data store 11 on demand.

An important part of the computing equipment is storage means 12. This contains programming instructions (e.g., for retrograde analysis control 20) and also the databases and lists which are needed to carry out the processing. As will be described in greater detail below, storage means 12 is divided into various functional areas.

The data processing equipment also includes a working store 14 which is required to hold sub-sets of bytes acquired from data store 11, for processing and for comparison with byte strings held in databases contained in the storage 12. Single bytes, ie. signal strings corresponding to individual graphemes, are transferred from the input buffer 10 to the working store 14 via check store 13 which has capacity for one byte. The byte in check store 13 is checked against lists contained in data storage 12 before transfer to the working store 14.

After successful matching with items contains in the working storage 12 strings are transferred from the working store 14 to the output store 15. For use when matching fails the equipment includes means to return a byte from the working store 14 to the data store 11.

In addition to other areas, eg for program instructions, the storage means 12 has four major storage areas. These areas will now be identified.

First the storage means has areas for two different lists of bytes. These are a first storage area 12.1 which contains a lists of bytes corresponding to the vowels and a second storage area 12.2 which contains a list of bytes corresponding to the consonants. (The vowels and the consonants have been previously identified in this specification).

The storage means 12 also contains two areas of storage which constitute two different, and substantial, linked databases. First there is the rime database 12.3 which is further divided into regions designated 12.31, 12,32, 12.33, etc. Each region has an input section containing bytes strings corresponding to "rimes" in graphemes and, as shown in the drawing, this includes 12.31 containing "ATS", 12.32 containing "EET", 12.33 containing "IGH" and many more sections not illustrated in the drawing.

The storage means 12 also contains a second major area 12.4, which contains byte strings equivalent to the onsets. As with the rimes, the onset database 12.4 is also divided into many regions. For example, it comprises 12.41 containing "C", 12.42 containing "STR" and 12.43 containing "H".

Each of the input sections (of 12.3 and 12.4) is linked to an output section which contains a string of bytes corresponding to the content of its input section.

It has already been stated that the operational method includes two different procedures. The first procedure utilises storage areas 12.1 and 12.3 whereas the second procedure utilises storage areas 12.2 and 12.4. It is emphasised that the areas of the database which are actually used are defined entirely by the procedure in operation. The procedures are used alternately and procedure number 1 is used first.

SPECIFIC EXAMPLE

Analysis of the word "HIGHSTREET"

It will be noted that this specific example relates to the word selected as the fourth specimen in the description given above. Therefore its rimes and onsets are already defined and the specific example explains how these are achieved by mechanical computation.

The analysis begins when the input buffer 10 transfers the byte string corresponding to the word "HIGHSTREET" into the data store 12. Thus, at the start of the process, the important stores have the contents as follows:

| STORE | CONTENT |
|---|---|
| 11 | HIGHSTREET |
| 13 | - - |
| 14 | - - |
| 15 | - - |

(The symbol "- -" indicates that the relevant store is empty).

The analysis begins with the first procedure because the analysis always begins with the first procedure. As mentioned above, the first procedure uses storage regions 12.1 and 12.3. The first procedure has two phases during which bytes are transferred from the data store 11 to the working store 14 via the check store 13. The first phase continues for so long as the bytes are not found in storage region 12.1.

The procedure is a retrograde which means that it works from the back of the word and therefore the first transfer is "T" which is not contained in region 12.1. The second transfer is "E" which is contained in the region 12.1 and therefore the second phase of the first procedure is initiated. This continues for as long as the byte in working store 14 is matched in 12.1 therefore the second "E" is transferred but the check fails when the next byte "R" is passed. At this stage the state of the various stores is as follows.

| STORE | CONTENT |
|---|---|
| 11 | HIGHST |
| 13 | R |
| 14 | EET |
| 15 | - - - |

The contents of the working store 14 are used to access storage area 12.3 and a match is found in region 12.32. Thus the match has succeeded and the content of the working store 14, namely "EET" is transferred to a region of the output store 15 so that the state of the various stores is as follows.

| STORE | CONTENT |
|---|---|
| 11 | HIGHST |
| 13 | R |
| 14 | - - |
| 15 | EET |

It will be noticed that the first rime has been found mechanically.

As mentioned above, the non-matching of "R" in the check store 13 terminated the first performance of the first procedure. The analysis continues but the second procedure is now used because the two procedures always alternate. The second procedure utilises the storage regions 12.2 and 12.4. The byte corresponding to "R" in check store 13 now matches because region 12.2 is now in use and this byte is contained therein. Therefore "R" is transferred to the working store 14 and the second procedure continues so long as the byte in check store 13 matches. Thus the letters "T", "S", "H" and "G" are all transferred via the check store 13. At this point the byte corresponding to "I" arrives in the check store 13 and the check fails because the byte corresponding to "I" is not contained in storage region 12.2. Since the check fails this performance of the second procedure terminates. The contents of the various stores are:

| STORE | CONTENT |
|---|---|
| 11 | "H" |
| 13 | "I" |
| 14 | "GHSTR" |
| 15 | "EET" |

The second procedure will attempt to match the content of the working store 14 with the database contained in 12.4 but no match will be achieved. Therefore the second procedure continues with its remedial part wherein the bytes are transferred back to the data store 11 via the check store 13. At each transfer it is attempted to locate the content of the working store 14 in storage area 12.4. A match will be achieved when the letters G and H have been returned because the string equivalent to "STR" is contained in region 12.42. Having achieved a match the content of the working store is put out into a region of the output store 15. At this point the content of the various stores is as follows.

| STORE | CONTENT |
|---|---|
| 11 | "HIG" |
| 13 | "H" |
| 14 | - - |
| 15 | "STR" and "EET" |

The second procedure was terminated by finding the match so the analysis now goes back to the first procedure and more particularly to the first phase of the first procedure. In this way the letters "H" and "G" are transferred to the working store 14, and the first phase ends. The second phase passes "I" and it terminates when "H" is transferred to the check store 13. At this stage the various stores have contents as follows:

| STORE | CONTENT |
|---|---|
| 11 | - - |
| 13 | "H" |
| 14 | "IGH" |
| 15 | "STR" and "EET". |

The first procedure now attempts to match the content of the working store 14 with the database in the storage area 12.3 and a match is found in region 12.33. Therefore the content of the working store 14 is transferred to a region of the output store 15.

The analysis now continues with the second procedure and the letter "H" (in the check store 13) is located in storage region 12.2 (note that this region is now in use because the analysis has now gone back to the second procedure). The analysis can now terminate because the data store 11 has no further bytes to transfer and the content of the working store, namely, "H", is found in region 12.43 of the storage means 12. Thus "H" is transferred to the output store 15, which contains the correct four strings found by mechanical analysis.

The necessary output strings having been located, it is only necessary to convert them using the fact that storage areas 12.3 and 12.4 are linked databases. Each region not only has the strings now contained in the output store, but each region has linked output regions containing strings corresponding to the appropriate phonemes. Therefore each string in the output store is used to access its appropriate region and hence produce the necessary output. The final step merely utilises a look-up table and this is possible because the important analysis has been completed.

As indicated above, the identified strings serve as access to the linked database and, in a simple system, there is one output string for each access string. However, pronunciation sometimes depends on context and improved conversion can be achieved by providing a plurality of outputs for at lest some of the access strings. Selecting the appropriate output stream depends upon analysing the context of the access stream, eg. to take into account the position in the word or what follows or what proceeds. This further complication does not affect the invention, which is solely concerned with the division into appropriate sections. It merely complicates the look-up process.

As was explained above, the invention is not necessarily required to produce an output because, in the case of failure, the complete system contains a default technique, eg. providing a phoneme equivalent for each grapheme. In order to complete the description of the technique, it is considered desirable to provide a brief indication of the circumstance in which this failure occurs and use of a default technique is required.

Failure Mode 1

The first failure mode will occur when the content of the data store does not contain a vowel which implies that it is not a word. As always, the analysis starts by using the first procedure and, more specifically, the first phase of the first procedure and this will continue so long as there is no match with the first list 12.1. Since the string and data store 11 contains no match, the first phase will continue until the beginning of the word and this indicates that there is a failure.

Second Failure Mode

This failure occurs when:

(i) the second procedure is in use;

(ii) the beginning of the word is reached and;

(iii) there is no match for the content of the working store 14 in the database 12.4.

This contrasts with failure to match during the middle of the word which implies that a vowel is contained in the check store 13. Failure at this stage permits the returning of bytes for later analysis by the first procedure and there is no failure, at least not at this point in the analysis. When the beginning of the word is reached, there is no possibility of further analysis and hence the analysis has to fail.

Third Failure Mode

The third failure mode occurs when the first procedure is in use and it is not possible to match the contents of the working store 14 with a string contained in the database 12.3. Under these circumstances the first procedure will transfer bytes back to the check store 13 and the data store 11 and this transfer can continue until working store 14 becomes empty and the analysis also fails.

In the second failure mode, it was explained that the second procedure is allowed to return bytes to input for later analysis by the second procedure. However, the transferred bytes must be matched at some time and this means during the next performance of the first procedure. The third failure mode corresponds to the case where it is not possible to achieve the later match.

Thus the method of the invention provides analysis of a data string into segments which can be converted using look-up tables. It is not necessary that the analysis shall succeed in every case but, given good databases, the method will work very frequently and enhance the performance of a complete system which comprises the other modules necessary for text to speech conversion.

What is claimed is:

1. Apparatus for use in a speech engine for producing synthetic speech from a digital signal which corresponds to a text in graphemes, said apparatus comprising:

a first module for converting the data representations corresponding to a text in graphemes into data representations corresponding to the same text in phonemes, said first module comprising:

a memory for storing onsets in graphemes and phonemes equivalent to the onsets and for storing rimes in graphemes and phonemes equivalent to the rimes, the onsets each consisting of a string of one or more consonants and the rimes each consisting of either a string of one or more vowels or a string of one or more vowels followed by a string of one or more consonants; and a control circuit for processing words of the text in graphemes by dividing the words into onsets and rimes in graphemes and then converting the onsets and rimes into phonemes using the stored phonemes equivalent to the onsets and rimes, wherein said control circuit is configured to process the words of the text in graphemes such that the end of each word is a rime; and a second module for converting the phonemes output by said first module into the digital signal used by said speech engine to produce synthetic speech.

2. The apparatus according to claim 1, wherein the dividing of the words of the text in graphemes into onsets and rimes in graphemes is a retrograde operation which begins from the ends of words.

3. The apparatus according to claim 1, wherein said memory further stores whole words in graphemes and the phonemes equivalent thereto and wherein said control circuit divides into onsets and rimes in graphemes those whole words of the text in graphemes which are not stored in said memory.

4. A method for producing synthetic speech comprising:

storing in a memory onsets in graphemes and phonemes equivalent thereto and rimes in graphemes and phonemes equivalent thereto, the onsets each consisting of a string of one or more consonants and the rimes each consisting of either a string of one or more vowels or a string of one or more vowels followed by a string of one or more consonants;

dividing words of the text in graphemes into onsets and rimes in graphemes, wherein the words are divided such that the end of each word is a rime;

converting the onsets and rimes into phonemes using the stored phonemes equivalent to the onsets and rimes; and producing synthetic speech by converting the phonemes into an audible waveform.

5. The method according to claim 4, wherein the dividing of the words of the text in graphemes into onsets and rimes in graphemes is a retrograde operation which begins from the ends of words.

6. The method according to claim 4, further comprising storing in said memory whole words in graphemes and the phoneme equivalents thereto and wherein only those whole words of the text in graphemes which are not stored in said memory are divided into onsets and rimes in graphemes.

7. Apparatus for use in a speech engine for producing synthetic speech from a digital signal which corresponds to a text in graphemes, said apparatus comprising:

a first module for converting the data representations corresponding to a text in graphemes into data representations corresponding to the same text in phonemes, said first module comprising:

a memory for storing onsets in graphemes and phonemes equivalent to the onsets and for storing rimes in graphemes and phonemes equivalent to the rimes, the onsets each consisting of a string of one or more consonants and the rimes each consisting of either a string of one or more vowels or a string of one or more vowels followed by a string of one or more consonants; and a control circuit for processing words of the text in graphemes by dividing the words into onsets and rimes in graphemes, said control circuit being configured to process the words in a retrograde manner using alternating first and second procedures for identifying the rimes and onsets in the words, the alternating first and second procedures being operable such that the end of each word is a rime, said control circuit being further configured to convert the identified onsets and rimes into phonemes using the stored phonemes equivalent to the onsets and rimes; and a second module for converting the phonemes output by said first module into the digital signal which is used by said speech engine to produce synthetic speech.

8. The apparatus according to claim 7, wherein the alternating first and second procedures are operable such that words may comprise adjacent rimes, but no adjacent onsets.

9. The apparatus according to claim 7, wherein the alternating first and second procedures are operable such that words may begin with either an onset or a rime.

10. A computerized apparatus for converting data representations corresponding to a text in graphemes, said text comprising words, into data representations corresponding to the same text in phonemes, said apparatus including a memory for storing rimes and onsets in graphemes and for storing phonemes equivalent to the rimes and onsets, and a control circuit for dividing the words of the text in graphemes into onsets in graphemes and rimes in graphemes and converting the onsets and rimes into phonemes; wherein the onsets each consists of strings of one or more constants and the rimes each consist of either a string of one or more vowels or a string of one or more vowels followed by a string of one or more consonants.

11. The computerized apparatus according to claim 10, wherein the division into onsets and rimes comprises splitting an internal string of consonants into a latter portion which is an onset associated with a following rime thereby identifying an earlier string of consonants for combination with one or more preceding vowels to form a rime.

12. The computerized apparatus according to claim 10, wherein the computerized apparatus comprises a database containing whole words in graphemes and their conversion into phonemes, words contained in the database being converted using said data base, other words not contained in the database being converted by division into rimes and onsets.

13. The computerized apparatus according to claim 10, which also converts the data representations corresponding to the phonemes into a digital waveform.

* * * * *